US006483066B1

(12) United States Patent
Erk et al.

(10) Patent No.: US 6,483,066 B1
(45) Date of Patent: Nov. 19, 2002

(54) SWITCHGEAR ASSEMBLIES HAVING SWITCHING DEVICES

(75) Inventors: Thomas Erk, Königs Wusterhausen (DE); Hartmut Schöntag, Neuendorf (DE); Andreas Stelzer, Berlin (DE); Reinhard Zeuke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/830,091

(22) PCT Filed: Oct. 12, 1999

(86) PCT No.: PCT/DE99/03309

§ 371 (c)(1),
(2), (4) Date: Apr. 23, 2001

(87) PCT Pub. No.: WO00/25334

PCT Pub. Date: May 4, 2000

(30) Foreign Application Priority Data

Oct. 23, 1998 (DE) ..... 198 50 206

(51) Int. Cl.[7] ..... H01H 33/66
(52) U.S. Cl. ..... 218/118; 218/154; 218/153
(58) Field of Search ..... 218/118, 119, 218/120, 134, 139, 155, 157

(56) References Cited

U.S. PATENT DOCUMENTS 4,650,939 A 3/1987 Millianowicz
5,753,875 A * 5/1998 Benke et al. ..... 200/289
5,818,003 A * 10/1998 Moldovan et al. ..... 218/151

FOREIGN PATENT DOCUMENTS

DE 42 26 772 A1 8/1992
GB 2 318 455 A 10/1997

OTHER PUBLICATIONS

Catalog HG 11.21, 1997, 3TL Vacuum Contactors, p. 3/5.

* cited by examiner

*Primary Examiner*—Elvin Enad
*Assistant Examiner*—M. Fishman
(74) *Attorney, Agent, or Firm*—Morrison & Foerster, LLP

(57) ABSTRACT

The invention relates to switchgear with switching devices that can be controlled by magnetic drive devices, especially vacuum circuit breakers, wherein the switching devices are arranged by blocks in a housing in correspondence with the number of phases to be switched, said housing enclosing the switching devices on three sides and said devices being releasably fixed by screws in the housing by a top and a bottom contact connection piece. The switching devices (VS) have separate housings that are formed by pole shells (PS) arranged as a mirror image of each other and the top and bottom contact connecting piece (KAo, KAu) form a top and a bottom cooling body (KKo, KKu) which are releasably fixed between separately arranged vacuum circuit breaker fixing webs (VB . . . ) of the pole shells (PS), wherein the top cooling body (KKo) is fitted in the peripheral area of the switching devices (VS) with ventilation slots (LS . . . ) extending centrally in relation to the switching devices and the bottom cooling body (KKu) is fitted in the peripheral area of the switching devices (VS) with air inlets (LE) arranged symmetrically in relation to the central axis. Said switchgear are used in power supply and distribution.

4 Claims, 2 Drawing Sheets

SWITCHGEAR ASSEMBLIES HAVING SWITCHING DEVICES

This application claims priority to International Application No. PCT/DE99/03309 filed Oct. 12, 1999 which was published in the German language on May 4, 2000.

TECHNICAL FIELD OF THE INVENTION

The invention relates to switchgear assemblies, and in particular, to switchgear assemblies having switching devices which can be controlled by magnetic drive devices having, for example, vacuum contactors.

BACKGROUND OF THE INVENTION

Switchgear assemblies are known, inter alia, from the document "Catalog HG 11.21, 1997, 3TL Vacuum Contactors, Page 3/5".

Conventional switchgear assemblies are equipped with vacuum contactors in the voltage range up to 12 kV (Kilo-Volts), with three vacuum contactors in each case being accommodated jointly in one housing. The three vacuum contactors are surrounded by the housing on three sides in such a manner that the upper and the lower contact connections of the vacuum contactors are freely accessible from the front. The housing of the vacuum contactors is bounded underneath by a magnetic drive device and, at the top, by an insulated cover. The design requirements relating to the necessary withstand voltage and thermal load capacity are solved by means of appropriately long distances between the live parts and by appropriately large dimensioning of the contact connecting pieces with a large surface area for adequate heat dissipation.

SUMMARY OF THE INVENTION

In one embodiment, a switchgear assembly, switching devices each having separate housings, the housings each formed by two separate pole shells arranged as mirror images of one another and, an upper and lower contact connecting piece respectively form an upper and a lower heat sink, the upper and the lower heat sink are each detachably mounted between separately associated vacuum contactor attachment webs of the pole shells, the upper heat sink is provided in the circumferential region of the switching devices (with ventilation slots running centrally with respect to them, and the lower heat sink is provided in the circumferential region of the switching devices with centrally symmetrically arranged air inlet openings.

In one aspect of the invention, the switchgear assembly wherein the upper heat sink has cooling ribs which point outward and are arranged centrally and are centrally symmetrical, and the lower heat sink has a spherical boundary contour which points outward.

In another aspect of the invention, the switchgear assembly wherein the upper and the lower heat sink are each provided with heat sink attachments which are arranged with mirror-image symmetry with respect to the longitudinal axis of the switching device, and the free ends of the upper and of the lower contact connection each point outward.

In still another aspect of the invention, the switchgear assembly wherein the switching devices can be controlled by magnetic drive devices having vacuum contactors, the switching devices each being arranged in blocks in the housing corresponding to the number of phases to be switched, and each being surrounded on three sides by the housing and, within the housing, being attached by screws by the upper and a lower contact connecting piece, such that they can be detached from said connecting pieces.

BRIEF DESCRIPTION OF THE DRAWINGS

The invention will be explained in more detail using an exemplary embodiment illustrated in three figures.

DETAILED DESCRIPTION OF THE INVENTION

Figure 1:
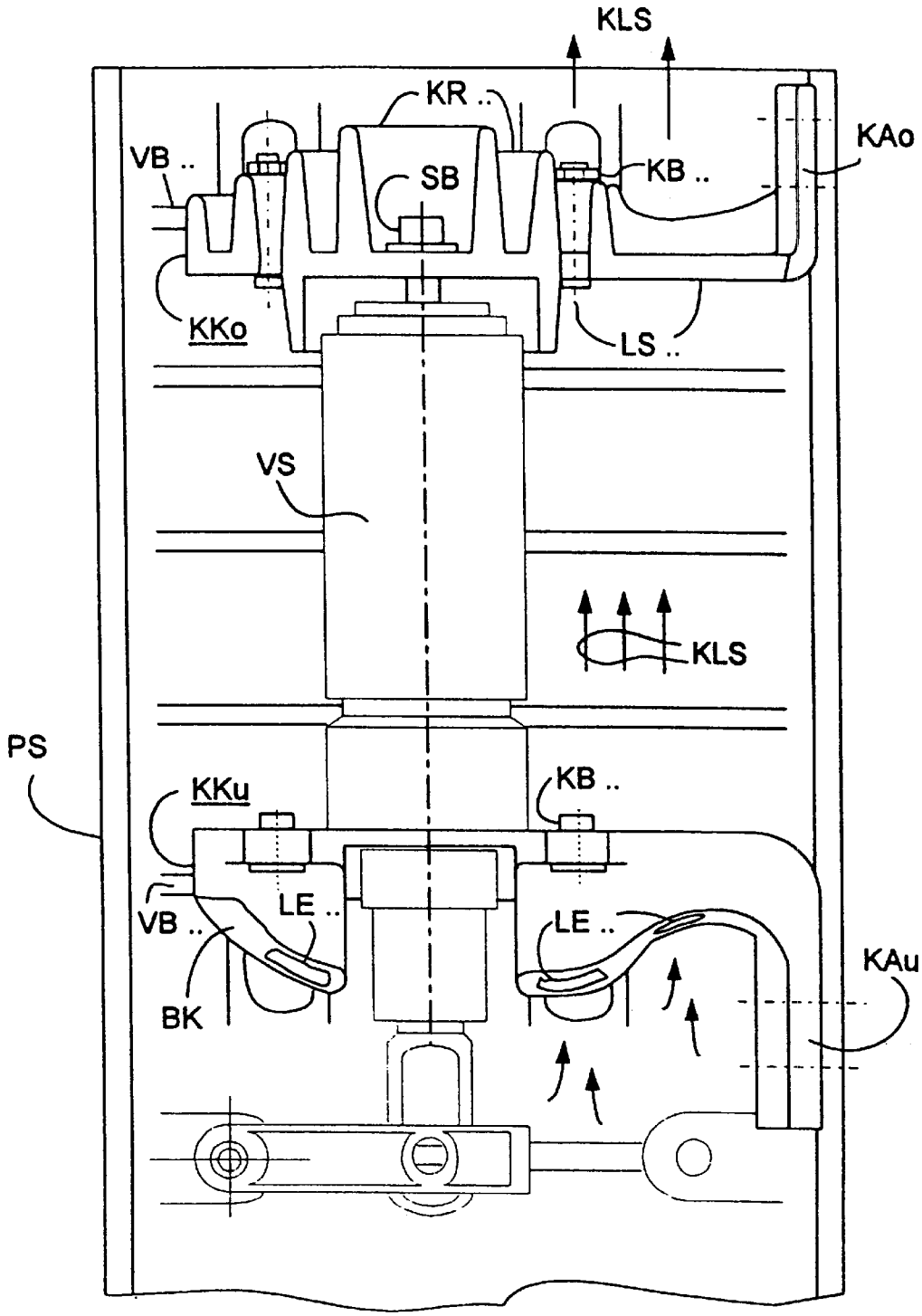
FIG. 1 shows a front view of the side area of the switching device, which is merely indicated, with the inner region of the pole shell.

The invention relates to switchgear assemblies to allow the voltage range to be increased to about 24 kV, in which the switching devices are likewise of a compact design, and the increased heating caused by the greater voltage range is dissipated considerably better.

According to the invention, this is achieved by, although not limited to, the following features:

the switching devices each have separate housings, the housings are each formed by two separate pole shells arranged as mirror images of one another, the upper and lower contact connecting piece respectively form an upper and a lower heat sink, the upper and the lower heat sink are each detachably mounted between separately associated vacuum contactor attachment webs of the pole shells, the upper heat sink is provided in the circumferential region of the switching devices with ventilation slots running centrally with respect to them, and the lower heat sink is provided in the circumferential region of the switching devices with centrally symmetrically arranged air inlet openings.

Replacement of the integral housing part by the two pole shells associated with the respective switching devices allows compact switchgear assemblies to be produced with the withstand voltages that have to be complied with without significantly enlarging the physical volume, for the voltage range up to 24 kV as well. The two pole shells, which are arranged as mirror images of one another and are attached by being screwed directly on the magnetic drive device can be matched to one another in a simple manner for the various switching devices and vacuum contactors by means of different separations. The standard pole shells thus allow virtually any desired housings to be assembled to accommodate the switching devices or vacuum contactors without any design changes. If the upper and lower contact connecting pieces are at the same time configured as corresponding upper and lower heat sinks, this allows adequate heat dissipation for the 24 kV voltage range. In this context, it may be regarded as being particularly advantageous to arrange the ventilation slots in the upper heat sink, and to arrange the air inlet openings in the lower heat sink. The fact that the pole shells are not closed at the top means that a cooling air flow can be passed deliberately from underneath through the air inlet openings onto the circumference of the switching device or vacuum contactor and its contact connections, escaping through the ventilation slots in the upper heat sink. This capability to guide the cooling air flow deliberately acts virtually as an active cooling system, thus allowing the increased thermal load capacity to be achieved in this voltage range.

In this context, one advantageous refinement of the invention also provides for at least the following features:

the upper heat sink has cooling ribs which point outward and are arranged centrally and centrally symmetrically, and the lower heat sink has a spherical boundary contour which points outward.

The cooling ribs pointing outward mean that greater amounts of heat can be dissipated per unit time compared to the enlargement of the surface area from known measures.

The spherical boundary contours of the lower heat sinks, which point outward in the same way, ensure a greater withstand voltage since the distances between them are greater.

A further advantageous refinement of the invention i s provided by at least the features: the upper and the lower heat sink are each provided with heat sink attachments which are arranged with mirror-image symmetry with respect to the longitudinal axis of the switching device, and the free ends of the upper and of the lower contact connection each point outward.

FIG. 1 shows the inside of the pole shell PS, to which the upper and the lower contact connection KAo and KAu together with the respectively associated upper and lower heat sink KKo and KKu are attached by means of screws using the respective heat sink attachment KB . . . To assist understanding, the switching device VS is indicated by a thin line in the drawing, in its installed position between the upper and lower heat sinks KKo and KKu within one pole shell. In order to show further details, the second pole shell, which is at the side, is not shown in FIG. 1. Vacuum contactor attachment webs VB . . . are provided within the pole shells PS and are used for attachment of the upper and lower heat sinks KKo and KKu by means of the heat sink attachments KB . . .

The illustration also shows that the switching device VS is connected at the upper heat sink KKo to the vacuum contact attachment SB, while the lower heat sink KKu essentially provides the means for fixing the switching device VS in position. The upper heat sink KKo furthermore has the upper contact connection KAo which, when installed between the pole shells PS—as already mentioned, this view shows only the rear pole shell—is freely accessible to produce the electrical connection. To improve the heat dissipation, the upper heat sink KKo is equipped with cooling ribs $KR_{...}$ which are arranged centrally with respect to the vacuum contactor VS and which are provided at their level from the inside to the outside with a reduced surface area corresponding to the thermal load that occurs. Ventilation slots $LS_{...}$ are indicated between the individual cooling ribs $KR_{...}$, out of which the cooling air flow KLS is passed out of the switching device VS.

The lower heat sink KKu is arranged underneath the switching device VS, which is merely indicated, a spherical boundary contour BK of which lower heat sink KAu and its lower contact connection KAu point outward —in the same way as the cooling ribs KR . . . and their upper contact connection KAo on the upper heat sink KKo. The lower heat sink KKu is provided in the circumferential region of the switching device VS with centrally symmetrically arranged air inlet openings LE . . . in such a manner that the cooling air flow KLS is produced between the lower and the upper heat sink and ensures adequate heat dissipation from the switching device VS in conjunction with the cooling ribs KR . . . on the upper heat sink KKo. The switching device is thus actively cooled by this cooling air flow KLS which is produced by the chimney stack effect, and can thus be used for the higher voltage range.

Figure 2:
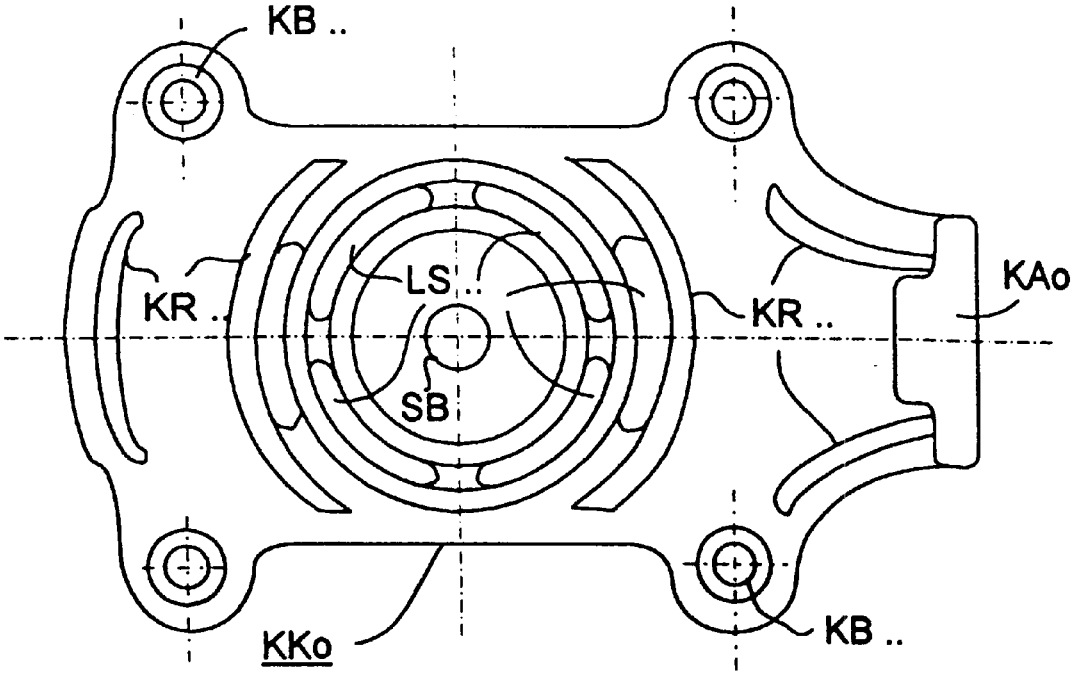
FIG. 2 shows further details of the upper heat sink.

FIG. 2 shows the upper heat sink KKo with the upper contact connection KAo, looking at the area of the immediately adjacent switching device, which is not shown. This shows in particular the central arrangement of some of the cooling ribs KR . . . , between which the ventilation slots LS are located. Heat sink attachments KB . . . are arranged centrally symmetrically and with mirror-image symmetry around the vacuum contactor attachment SB of the upper heat sink KKo. Furthermore, further cooling ribs KR. . . are provided in the edge regions of the upper heat sinks KKo for reinforcement and in order to enlarge the surface area.

Figure 3:
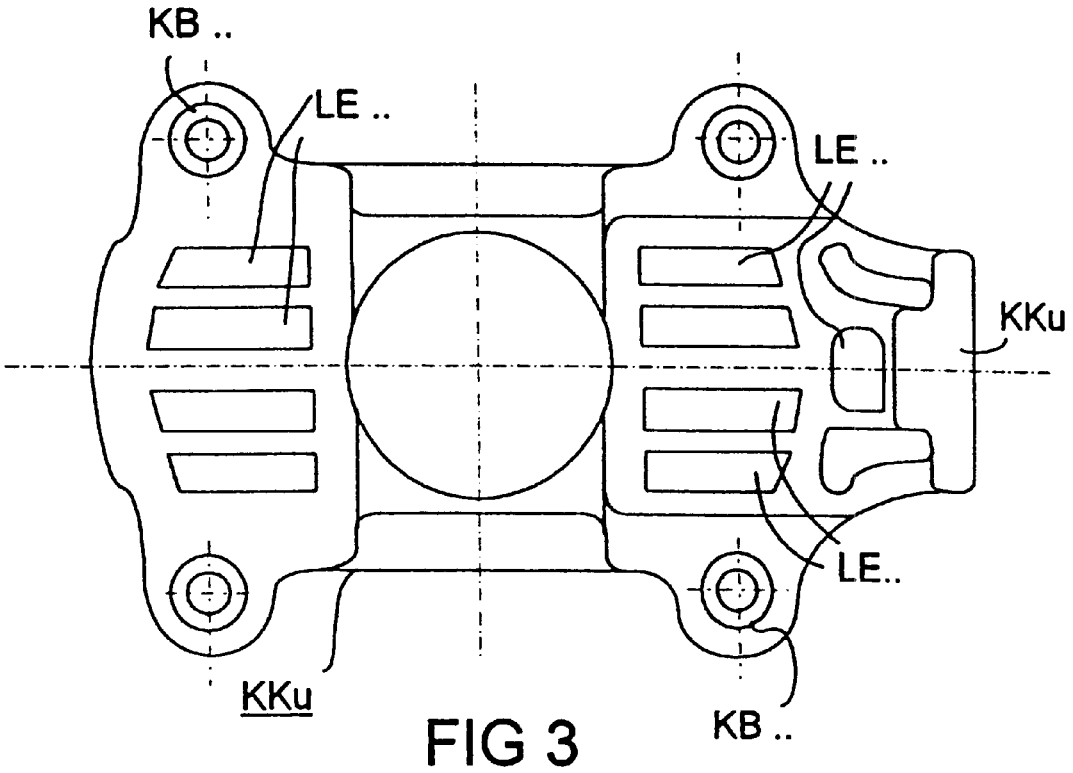
FIG. 3 shows further details of the lower heat sink.

FIG. 3 shows further details of the lower heat sink KKu with the lower contact connection KAu, looking at the outside facing away from the switching device. This shows in particular the arrangement of the air inlet openings LE . . . alongside the switching device, which is likewise not illustrated here. The centrally symmetrical arrangement of the air inlet openings LE . . . at the sides means that they can be designed to be correspondingly large in order to increase the so-called chimney stack effect, without any possibility of stability loss occurring due to reductions in the cross section.

Like the upper heat sinks kko (FIG. 2), the lower heat sinks kku are also arranged centrally and with mirror-image symmetry around the switching device, which is not illustrated.

What is claimed is:

1. A switchgear assembly, comprising:

switching devices each having separate housings, the housings each formed by two separate pole shells arranged as mirror images of one another; and an upper and lower contact connecting piece respectively forming an upper and a lower heat sink, the upper and the lower heat sink are each fixedly mounted on the respective housings by separately associated vacuum contactor attachment webs of the pole shells, the upper heat sink is provided in the circumferential region of the switching devices with ventilation slots running centrally with respect to them, and the lower heat sink is provided in the circumferential region of the switching devices with centrally symmetrically arranged air inlet openings.

2. The switchgear assembly of claim 1, wherein the upper heat sink has cooling ribs which point outward and are arranged centrally and are centrally symmetrical, and the lower heat sink has a spherical boundary contour which points outward.

3. The switchgear assembly of claim 1, wherein the upper and the lower heat sink are each provided with heat sink attachments which are arranged with mirror-image symmetry with respect to the longitudinal axis of the switching device, and the free ends of the upper and of the lower contact connection each point outward.

4. The switchgear assembly of claim 1, wherein the switching devices can be controlled by magnetic drive devices having the vacuum contactors, the switching devices each being arranged in blocks in the housing corresponding to the number of phases to be switched, and each being surrounded on three sides by the housing and, within the housing, being attached by screws by the upper and the lower contact connecting piece, such that they can be detached from said connecting pieces.

* * * * *